US005883967A

United States Patent [19]

House

[11] Patent Number: 5,883,967

[45] Date of Patent: Mar. 16, 1999

[54] SLOTTED DIAPHRAGM LOUDSPEAKER

[75] Inventor: William Neal House, Bloomington, Ind.

[73] Assignee: Harman International Industries, Incorporated, Northridge, Calif.

[21] Appl. No.: 843,384

[22] Filed: Apr. 15, 1997

[51] Int. Cl.[6] ..... H04R 25/00

[52] U.S. Cl. ..... 381/398; 381/423; 381/412

[58] Field of Search ..... 381/192, 193, 381/194, 196, 199, 201, 202, 203, 396, 397, 398, 400, 407, 412, 414, 423, 424, 430, 431

[56] References Cited

U.S. PATENT DOCUMENTS

| | | | |
|---|---|---|---|
| 3,067,366 | 12/1962 | Hofman . | |
| 3,127,544 | 3/1964 | Blume, Jr. . | |
| 3,134,057 | 5/1964 | Tsunoo et al. | 381/199 |
| 3,153,463 | 10/1964 | Novak . | |
| 3,168,686 | 2/1965 | King et al. . | |
| 3,737,822 | 6/1973 | Buus et al. . | |
| 4,117,431 | 9/1978 | Eicher . | |
| 4,210,786 | 7/1980 | Winey . | |
| 4,317,965 | 3/1982 | Toyoda . | |
| 4,384,173 | 5/1983 | Briefer et al. . | |
| 4,385,210 | 5/1983 | Marquiss . | |
| 4,471,172 | 9/1984 | Winey . | |
| 4,508,941 | 4/1985 | Wiggins . | |
| 4,578,663 | 3/1986 | Sanders et al. . | |
| 4,628,154 | 12/1986 | Kort . | |
| 4,717,876 | 1/1988 | Masi et al. . | |
| 4,731,598 | 3/1988 | Clarke . | |
| 4,792,978 | 12/1988 | Marquiss . | |
| 4,803,733 | 2/1989 | Carver et al. . | |
| 4,821,330 | 4/1989 | Pfleiderer . | |
| 4,856,071 | 8/1989 | Marquiss . | |
| 4,868,882 | 9/1989 | Ziegenberg et al. . | |
| 4,869,811 | 9/1989 | Wolanski et al. . | |
| 4,899,390 | 2/1990 | Takewa et al. . | |
| 5,003,609 | 3/1991 | Muraoka . | |
| 5,003,610 | 3/1991 | Adachi et al. . | |
| 5,081,684 | 1/1992 | House . | |
| 5,123,053 | 6/1992 | House . | |
| 5,142,260 | 8/1992 | House . | |
| 5,283,836 | 2/1994 | Trufitt . | |
| 5,297,214 | 3/1994 | Bruney . | |
| 5,425,107 | 6/1995 | Bertagni et al. . | |
| 5,430,805 | 7/1995 | Stevenson et al. . | |

FOREIGN PATENT DOCUMENTS

| | | |
|---|---|---|
| 713205 | 7/1965 | Canada . |
| 56-27600 A | 3/1981 | Japan . |
| 423197 | 9/1974 | U.S.S.R. . |
| 964824 | 7/1964 | United Kingdom . |

*Primary Examiner*—Huyen Le
*Attorney, Agent, or Firm*—Barnes & Thornburg

[57] ABSTRACT

A loudspeaker comprises a diaphragm having an outer perimeter, a voice coil, a frame for supporting the diaphragm, and a motor stator providing a magnetic field in which the voice coil is supported. Current through the voice coil reciprocates the voice coil and the diaphragm coupled thereto. Ribs extend outwardly at the perimeter of the diaphragm to mount the voice coil to the perimeter of the diaphragm. The motor stator includes at least one inner flux return providing slots through which the ribs extend between the perimeter of the diaphragm and the voice coil. Alternatively, a loudspeaker comprises a diaphragm having an outer perimeter and a central axis defining between them a relatively inner region of the diaphragm extending outwardly from the axis and a relatively outer region of the diaphragm extending inwardly from the perimeter, a voice coil, a frame for supporting the diaphragm, and a motor stator providing a magnetic field in which the voice coil is supported. Current through the voice coil reciprocates the voice coil and the diaphragm coupled thereto. Ribs extend outwardly from the inner region and inwardly from the outer region to support the voice coil between the inner and outer regions. The motor stator includes at least one inner and/or outer flux return providing slots through which the ribs extend.

25 Claims, 4 Drawing Sheets

SLOTTED DIAPHRAGM LOUDSPEAKER

The present invention relates to electrodynamic loudspeakers, and particularly to a loudspeaker having a slotted diaphragm.

A variety of loudspeakers are known in the art. There are, for example, the loudspeakers disclosed in U.S. Pat. Nos. 3,153,463; 4,868,882; 4,317,965; 5,123,053; 4,210,786; 5,081,684; 5,142,260; 5,283,386; 5,297,214; and 5,430,805. No representation is intended hereby, and none should be inferred, that a complete search has been made of the prior art, or that no better art references than those listed are available.

According to an aspect of the invention, a loudspeaker comprises a diaphragm having an outer perimeter, a voice coil, means for mounting the voice coil to the perimeter, a frame for supporting the diaphragm, and a motor stator providing a magnetic field in which the voice coil is supported. Current through the voice coil reciprocates the voice coil and the diaphragm coupled thereto. The means for mounting the voice coil to the perimeter comprises ribs extending outwardly at the perimeter of the diaphragm. The motor stator includes at least one inner flux return providing slots through which the ribs extend between the perimeter of the diaphragm and the voice coil.

Illustratively according to this aspect of the invention, the motor stator further comprises at least one permanent magnet oriented adjacent the at least one inner flux return.

Further illustratively according to this aspect of the invention, the at least one inner flux return comprises multiple inner flux returns. The slots are defined between adjacent ones of the inner flux returns.

Additionally illustratively according to this aspect of the invention, the motor stator further comprises at least one permanent magnet oriented adjacent at least one of the multiple inner flux returns.

Further illustratively according to this aspect of the invention, the motor stator comprises at least one permanent magnet oriented adjacent all of the multiple inner flux returns.

Additionally illustratively according to this aspect of the invention, the motor stator comprises at least two permanent magnets oriented adjacent all of the multiple inner flux returns.

Further illustratively according to this aspect of the invention, the motor stator further comprises at least one outer flux return. The at least one inner flux return and the at least one outer flux return define between them an air gap. The magnetic field is established in the air gap. The means for supporting the voice coil in the magnetic field comprises means for supporting the voice coil in the air gap.

Additionally illustratively according to this aspect of the invention, the motor stator further comprises a permanent magnet oriented adjacent the at least one inner flux return and the at least one outer flux return.

According to another aspect of the invention, a loudspeaker comprises a diaphragm having an outer perimeter and a central axis defining between them a relatively inner region of the diaphragm extending outwardly from the axis and a relatively outer region of the diaphragm extending inwardly from the perimeter, a voice coil, a frame for supporting the diaphragm, and a motor stator providing a magnetic field in which the voice coil is supported. Current through the voice coil reciprocates the voice coil and the diaphragm coupled thereto. The means for mounting the voice coil comprises first ribs extending outwardly from the inner region. The first ribs are coupled to the voice coil between the inner and outer regions. The motor stator includes at least one inner flux return providing first slots through which the first ribs extend between the inner region and the voice coil.

Illustratively according to this aspect of the invention, the at least one inner flux return comprises multiple inner flux returns. The first slots are defined between adjacent ones of the inner flux returns.

Further illustratively according to this aspect of the invention, the motor stator further comprises at least one permanent magnet oriented adjacent the multiple inner flux returns.

Additionally illustratively according to this aspect of the invention, the motor stator comprises multiple permanent magnets oriented adjacent the multiple inner flux returns.

Further illustratively according to this aspect of the invention, the loudspeaker further comprises second ribs extending inwardly from the outer region. The second ribs are coupled to the voice coil between the inner and outer regions. The motor stator includes at least one outer flux return providing second slots through which the second ribs extend between the outer region and the voice coil.

Additionally illustratively according to this aspect of the invention, the motor stator comprises at least one outer flux return. The at least one inner flux return and the at least one outer flux return define between them an air gap. The magnetic field is established in the air gap.

Further illustratively according to this aspect of the invention, the at least one outer flux return comprises multiple outer flux returns. The second slots are defined between adjacent ones of the outer flux returns.

Additionally illustratively according to this aspect of the invention, the motor stator further comprises at least one permanent magnet oriented adjacent the multiple outer flux returns.

According to yet another aspect of the invention, a loudspeaker comprises a diaphragm having an outer perimeter and a central axis defining between them a relatively inner region of the diaphragm extending outwardly from the axis and a relatively outer region of the diaphragm extending inwardly from the perimeter, a voice coil, a frame for supporting the diaphragm, and a motor stator providing a magnetic field in which the voice coil is supported. Current through the voice coil reciprocates the voice coil and the diaphragm coupled thereto. The means for mounting the voice coil comprises first ribs extending inwardly from the outer region. The first ribs support the voice coil between the inner and outer regions. The motor stator includes at least one outer flux return providing first slots through which the first ribs extend between the outer region and the voice coil.

Illustratively according to this aspect of the invention, the at least one outer flux return comprises multiple outer flux returns. The first slots are defined between adjacent ones of the outer flux returns.

Further illustratively according to this aspect of the invention, the motor stator further comprises multiple permanent magnets oriented adjacent the multiple outer flux returns.

The invention may best be understood by referring to the following detailed description and accompanying drawings which illustrate the invention. In the drawings.

Figure 1:
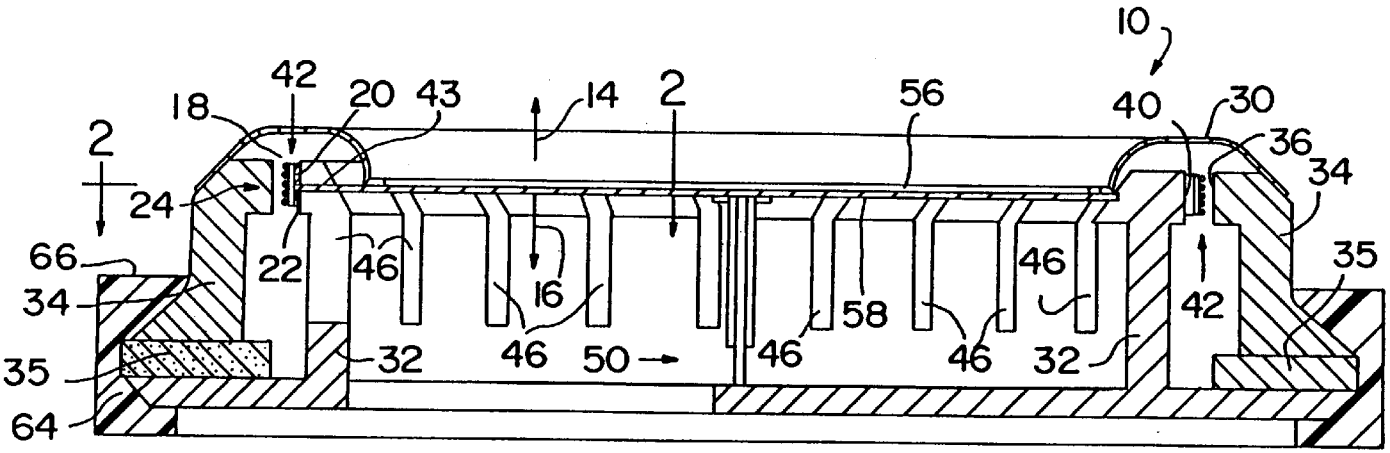
FIG. 1 illustrates a transverse sectional view through a loudspeaker constructed according to the invention.
Figure 2:
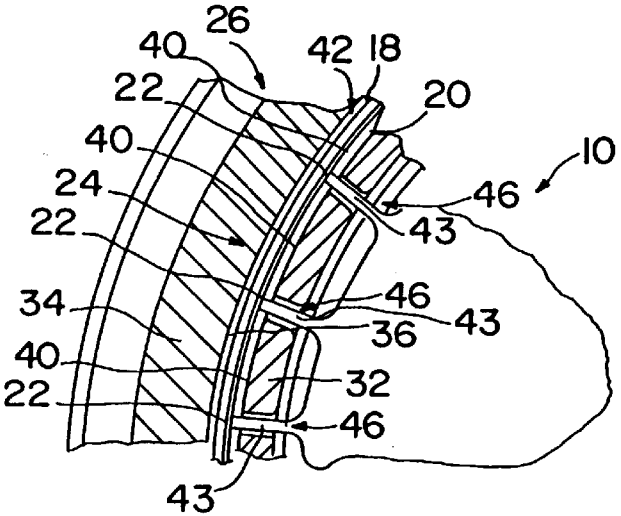
FIG. 2 illustrates a fragmentary sectional view taken generally along section lines 2—2 of FIG. 1.

Referring now to FIGS. 1–2, a loudspeaker 10 includes a diaphragm 12 which moves back and forth in the directions indicated by arrows 14, 16 in response to current flow through a voice coil 18 formed on a right cylindrical coil form 20 mounted at several locations 22 to the outer perimeter 24 of diaphragm 12. Diaphragm 12 is supported from a combination frame and loudspeaker voice coil motor stator 26 by an outer surround or compliance 30. The combination frame and motor stator 26 includes an inner return 32 which supports lines of magnetic flux, an outer return 34 which supports lines of magnetic flux, and a permanent magnet 35 which provides the magnetic flux to returns 32, 34. An outer pole 36 is formed on an inwardly facing surface of return 34. It should be clearly understood that loudspeaker 10 can be mounted in any orientation, for example, upside down from the orientation illustrated in FIG. 1 in, for example, the ceiling of a room or the headliner of an automobile, or turned at 90° or other appropriate angle to the orientation illustrated in FIG. 1 to mount in, for example, a wall of a room or a door or kick panel of an automobile. Thus, in the context of this application, such terms as upwardly and downwardly are used for purposes of convenience and are not intended to limit the scope of this invention.

Inner poles 40 are formed on outwardly facing surfaces of return 32. Coil form 20 and the voice coil 18 supported on coil form 20 reciprocate in the magnetic field in the air gap 42 between poles 36, 40 in response to alternating current flow in voice coil 18. Diaphragm 12 which is secured at perimetrally spaced locations 22 to coil form 20 moves with coil form 20. The frequency of the alternating current in coil 18 determines the frequency of the audio reproduced by diaphragm 12. As best illustrated in FIG. 2, slots 46 are formed between adjacent inner poles 40. Ribs extend outward from the perimeter of diaphragm 12 through these slots 46 to coil form 20.

A linear bearing 50 including a low-friction sleeve and a complementarily configured rod of any suitable materials may be provided to aid in promoting linear motion of diaphragm 12. However, depending upon the diaphragm 12, this may not be necessary or even desirable. Compliance 30 is coupled at its perimetrally inner extent to diaphragm 12 and at its perimetrally outer extent adjacent the uppermost or forwardmost region of outer return 34. This reduces edge effects between the forward radiated signal from surface 56 of diaphragm 12 and the backward radiated signal from surface 58 thereof.

Diaphragm 12 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnet 35 can be any suitable type, such as, for example, ceramic, rare earth, AlNiCo, and so on. Flux returns 32, 34 could be any suitable materials. Of course, one or both of the inner and outer returns 32, 34 could be constructed in whole or in part from permanent magnetic material, in which case a separate permanent magnet 35 would not be necessary. The remainder 64 of the frame illustratively could be formed in whole or in part from metal, such as steel or aluminum, or from any suitable filled or unfilled resin, or other suitable material and can provide a mounting surface 66 to aid in mounting the loudspeaker 10 in, for example, a baffle (not shown).

Figure 3:
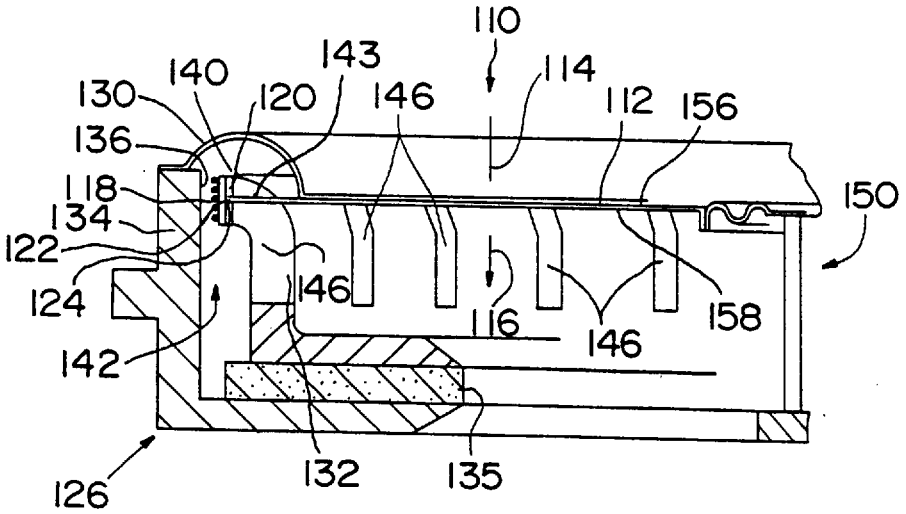
FIG. 3 illustrates a fragmentary transverse sectional view through a loudspeaker constructed according to the invention.

Referring now to FIG. 3, a loudspeaker 110 includes a diaphragm 112 which moves back and forth in the directions indicated by arrows 114, 116 in response to current flow through a voice coil 118 formed on a right cylindrical coil form 120 mounted at several locations to the outer perimeter 124 of diaphragm 112. Diaphragm 112 is supported from a combination frame and loudspeaker voice coil motor stator 126 by an outer surround or compliance 130. The combination frame and motor stator 126 includes an inner return 132 which supports lines of magnetic flux, an outer return 134 which supports lines of magnetic flux, and a permanent magnet 135 which provides the magnetic flux to returns 132, 134. An outer pole 136 is formed on an inwardly facing surface of return 134. Again, loudspeaker 110 can be mounted in any desired orientation.

Inner poles 140 are formed on outwardly facing surfaces of return 132. Coil form 120 and the voice coil 118 supported on coil form 120 reciprocate in the magnetic field in the air gap 142 between poles 136, 140 in response to alternating current flow in voice coil 118. Diaphragm 112 which is secured at perimetrally spaced locations 122 to coil form 120 moves with coil form 120. Slots 146 are formed between adjacent inner poles 140. Ribs extend outward from the perimeter of diaphragm 112 through slots 146 to coil form 120.

A diaphragm support 150 of the general type described in U.S. Pat. No. 5,123,053 and constructed from any suitable material can be provided to aid in promoting linear motion of diaphragm 112. However, depending upon the diaphragm 112, this may not be necessary or even desirable. Compliance 130 is coupled at its perimetrally inner extent to diaphragm 112 and at its perimetrally outer extent to the uppermost or forwardmost region of outer return 134. This minimizes cancellation or edge effects between the forward radiated signal from surface 156 of diaphragm 112 and the backward radiated signal from surface 158 thereof.

Again, diaphragm 112 can be constructed in whole or in part from any suitable material such as stiff, treated paper, filled or unfilled resin formed, for example, into relatively stiff closed or open-cell foam sheets, metal foil formed, for example, into honeycomb cellular configuration, or the like. Magnet 135 can be any suitable type, such as, for example, ceramic, rare earth, AlNiCo, and so on. Flux returns 132, 134 could be any suitable material. Of course, one or both of the inner and outer returns 132, 134 could be constructed in whole or in part from permanent magnetic material, in which case a separate permanent magnet 135 would not be necessary. The remainder of the frame illustratively could be formed in whole or in part from metal, such as steel or aluminum, or from any suitable filled or unfilled resin, or from any other suitable material.

Figure 4:
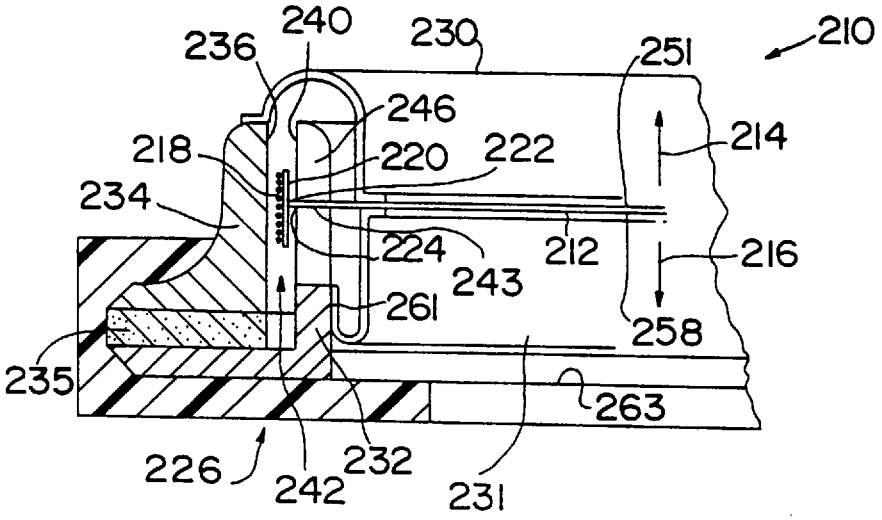
FIG. 4 illustrates a fragmentary transverse sectional view through a loudspeaker constructed according to the invention.

Referring now to FIG. 4, a loudspeaker 210 includes a diaphragm 212 which moves back and forth in the directions indicated by arrows 214, 216 in response to current flow through a voice coil 218 formed on a right cylindrical coil form 220 mounted at several locations 222 to the outer perimeter 224 of diaphragm 212. Diaphragm 212 is supported from a combination frame and loudspeaker voice coil motor stator 226 by compliances 230 and 231. The combination frame and motor stator 226 includes an inner return 232 which supports lines of magnetic flux, an outer return 234 which supports lines of magnetic flux, and a permanent magnet 235 which provides the magnetic flux to returns 232, 234. An outer pole 236 is formed on an axially inwardly facing surface of return 234. Again, loudspeaker 210 can be mounted in any orientation.

Inner poles 240 are formed on outwardly facing surfaces of return 232. Coil form 220 and the voice coil 218 supported on coil form 220 reciprocate in the magnetic field in the air gap 242 between poles 236, 240 in response to alternating current flow in voice coil 218. Diaphragm 212 which is secured at perimetrally spaced locations 222 to coil form 220 moves with coil form 220. Slots 246 are formed between adjacent inner poles 240. Ribs extend outward from the perimeter of diaphragm 212 through slots 246 to coil form 220.

Compliances 230 and 231 are coupled at their perimetrally inner extents to the upwardly facing 251 and downwardly facing 258 surfaces, respectively, of diaphragm 212. Compliances 230 and 231 are coupled at their perimetrally outer extents to the uppermost or forwardmost region of outer return 234 and the inwardly facing surface 261 of inner return 232, respectively. Compliance 231 could instead be coupled, for example, to the axially forwardly (in FIG. 4, upwardly) facing surface 263 of frame 226 adjacent inner return 232. In either case, cancellation or edge effects between the forward radiated signal from surface 251 of diaphragm 212 and the backward radiated signal from surface 258 thereof at edge 260 thereof are minimized.

Again, diaphragm 212 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnet 235 can be any suitable type, such as, for example, ceramic, rare earth, AlNiCo, and so on. Flux returns 232, 234 could be any suitable material. Of course, one or both of the inner and outer returns 232, 234 could be constructed in whole or in part from permanent magnetic material, in which case a separate permanent magnet 235 would not be necessary. The remainder of the frame illustratively could be formed in whole or in part from metal, such as steel or aluminum, or from any suitable filled or unfilled resin, or from any other suitable material.

Figure 5:
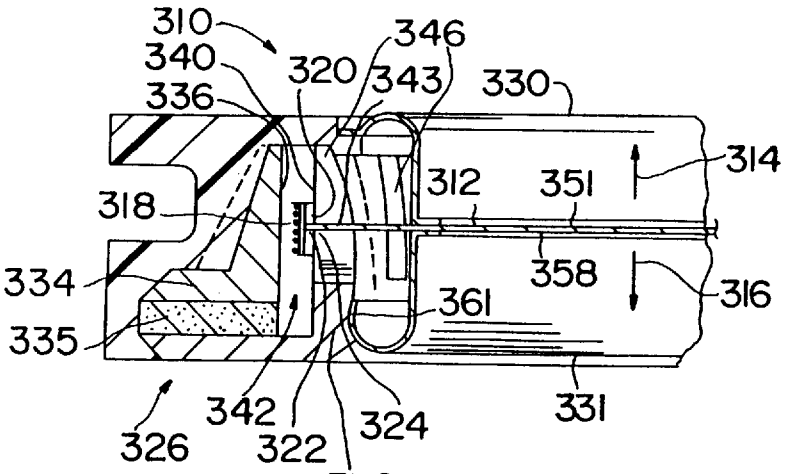
FIG. 5 illustrates a fragmentary transverse sectional view through a loudspeaker constructed according to the invention.

Fragmentary sectional views of several, although by no means all, other constructions are illustrated in FIGS. 5–10. Referring to FIG. 5, a loudspeaker 310 includes a diaphragm 312 which moves back and forth in the directions indicated by arrows 314, 316 in response to current flow through a voice coil 318 formed on a right cylindrical coil form 320 mounted at several locations 322 to the outer perimeter 324 of diaphragm 312. Diaphragm 312 is supported from a combination frame and loudspeaker voice coil motor stator 326 by compliances 330 and 331. The combination frame and motor stator 326 includes an inner return 332 which supports lines of magnetic flux, an outer return 334 which supports lines of magnetic flux, and a permanent magnet 335 which provides the magnetic flux to returns 332, 334. An outer pole 336 is formed on an axially inwardly facing surface of return 334. Loudspeaker 310 can be mounted in any orientation.

Inner poles 340 are formed on outwardly facing surfaces of return 332. Coil form 320 and the voice coil 318 supported on coil form 320 reciprocate in the magnetic field in the air gap 342 between poles 336, 340 in response to alternating current flow in voice coil 318. Diaphragm 312 which is secured at perimetrally spaced locations 322 to coil form 320 moves with coil form 320. Slots 346 are formed between adjacent inner poles 340. Ribs extend outward from the perimeter of diaphragm 312 through slots 346 to coil form 320.

Compliances 330 and 331 are coupled at their perimetrally inner extents to the upwardly facing 351 and downwardly facing 358 surfaces, respectively, of diaphragm 312. Compliances 330 and 331 are coupled at their perimetrally outer extents adjacent the uppermost or forwardmost extent of frame/motor stator 326 and the inwardly facing surface 361 of inner return 332. Cancellation or edge effects between the forward radiated signal from surface 351 of diaphragm 312 and the backward radiated signal from surface 358 thereof at edge 360 thereof are minimized.

Again, diaphragm 312 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnet 335 can be any suitable type, such as, for example, ceramic, rare earth, AlNiCo, and so on. Flux returns 332, 334 could be any suitable material. Of course, one or both of the inner and outer returns 332, 334 could be constructed in whole or in part from permanent magnetic material, in which case a separate permanent magnet 335 would not be necessary. The remainder of the frame illustratively could be formed in whole or in part from metal, such as steel or aluminum, or from any suitable filled or unfilled resin, or from any other suitable material.

It will be appreciated that in the embodiment illustrated in FIG. 5, the profiles of the inner and outer returns 332,334 are contoured. This is done to spread the flux in the regions of returns 332,334 nearer magnet 335 and to compress the flux in the regions of returns 332,334 more remote from magnet 335. A more uniform magnetic field throughout the air gap 342 can result from such contouring of the returns 332, 334. Different profiles can achieve this effect, as indicated by the broken lines in FIG. 5. It may be achievable in appropriate circumstances by contouring only one or the other of returns 332, 334, although in the FIG. 5 embodiment both are contoured. Another technique which can be used to promote such uniformity is by decreasing the width of the air gap itself from regions closer in the flux path to the permanent magnet toward regions more remote in the flux path from the permanent magnet. Such control on the linearity of the magnetic field throughout the air gap may or may not be necessary or desirable in a particular loudspeaker design.

Figure 6:
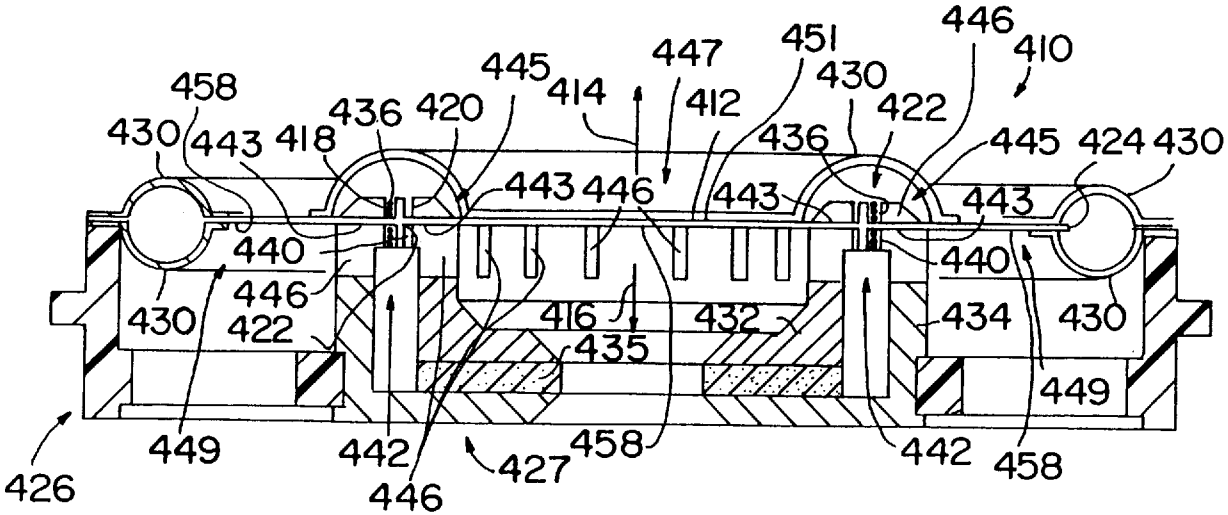
FIG. 6 illustrates a fragmentary transverse sectional view through a loudspeaker constructed according to the invention.

Referring now to FIG. 6, a loudspeaker 410 includes a diaphragm 412 which moves back and forth in the directions indicated by arrows 414, 416 in response to current flow through a voice coil 418 formed on a right cylindrical coil form 420 mounted at several equally spaced locations 422 around diaphragm 412 between its axis 414, 416 and its outer perimeter 424. Diaphragm 412 is supported from a frame 426 by outer surrounds or compliances 430. A motor stator 427 spaced inwardly from the outer perimeter of frame 426 includes an inner return 432 which supports lines of magnetic flux, an outer return 434 which supports lines of magnetic flux, and a permanent magnet 435 which provides the magnetic flux to returns 432, 434. Outer poles 436 are formed on axially forwardmost (in FIG. 6 uppermost) inwardly, that is, axially, facing surfaces of return 434. Loudspeaker 410 can be mounted in any orientation.

Inner poles 440 are formed on axially forwardmost (in FIG. 6, uppermost), outwardly facing surfaces of return 432. Coil form 420 and the voice coil 418 supported on coil form 420 reciprocate in the extending magnetic field in the air gap 442 between poles 436, 440 in response to alternating current flow in voice coil 418. Diaphragm 412 includes ribs 443 which extend through a region 445 between an inner region 447 of diaphragm 412 and an outer region 449 thereof Ribs 443 support coil form 420 in air gap 442. Slots 446 are formed between adjacent outer poles 436 and between adjacent inner poles 440. Ribs 443 extend through slots 446.

A compliance 430 is coupled across region 445 and mounted at is perimetrally inner and outer extents to upwardly facing surface 451 of diaphragm 412 in regions 447 and 449. Cancellation or edge effects between the forward radiated signal from surface 451 of diaphragm 412 and the backward radiated signal from surface 458 thereof are minimized.

Figure 7:
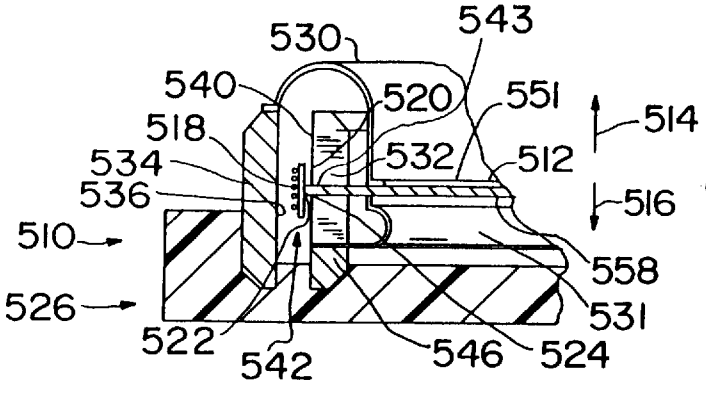
FIG. 7 illustrates a fragmentary transverse sectional view through a loudspeaker constructed according to the invention.

Referring now to FIG. 7, a loudspeaker 510 includes a diaphragm 512 which moves back and forth in the directions indicated by arrows 514, 516 in response to current flow through a voice coil 518 formed on a right cylindrical coil form 520 mounted at several locations 522 to the outer perimeter 524 of diaphragm 512. Diaphragm 512 is supported from a combination frame and loudspeaker voice coil motor stator 526 by forward (in FIG. 7 upper) and rearward (in FIG. 7, lower) compliances 530 and 531. The combination frame and motor stator 526 is a so-called returnless voice coil motor stator. Any of a number of other returnless voice coil motor configurations are also adaptable for use with the present invention. Without seeking in any way to limit the number of such returnless voice coil motor configurations, reference is made to the configurations illustrated and described in U.S. Pat. No. 5,142,260 and the references cited therein. An outer pole 536 is formed on the inwardly facing surface of an outer stator member 534. Loudspeaker 510 can be mounted in any orientation.

Inner poles 540 are formed on outwardly facing surfaces of inner stator member 532. Coil form 520 and the voice coil 518 supported on coil form 520 reciprocate in the magnetic field in the air gap 542 between poles 536, 540 in response to alternating current flow in voice coil 518. Diaphragm 512 which is secured at perimetrally spaced locations 522 to coil form 520 moves with coil form 520. Slots 546 are formed between adjacent inner poles 540. Ribs extend outward from the perimeter of diaphragm 512 through slots 546 to coil form 520. In the embodiment illustrated in FIG. 7, at least a portion of at least one of stator members 532 and 534 must be constructed from (a) suitable magnetic material(s) to provide the necessary magnetic flux in air gap 542. The remainder of flux returns 532, 534 could be any suitable material. It should be understood that the invention may be employed with other configurations of returnless voice coil motors having, for example, only inner stator members 534.

Compliances 530 and 531 are coupled at their perimetrally inner extents to the upwardly facing 551 and downwardly facing 558 surfaces, respectively, of diaphragm 512. Compliances 530 and 531 are coupled at their perimetrally outer extents to the uppermost or forwardmost region and lowermost or rearwardmost region, of outer stator member 534 and inner stator member 532, respectively. Cancellation or edge effects between the forward radiated signal from surface 551 of diaphragm 512 and the backward radiated signal from surface 558 thereof are minimized.

Again, diaphragm 512 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. The remainder of the frame illustratively could be formed in whole or in part from metal, such as steel or aluminum, or from any suitable filled or unfilled resin, or from any other suitable material.

Figure 8:
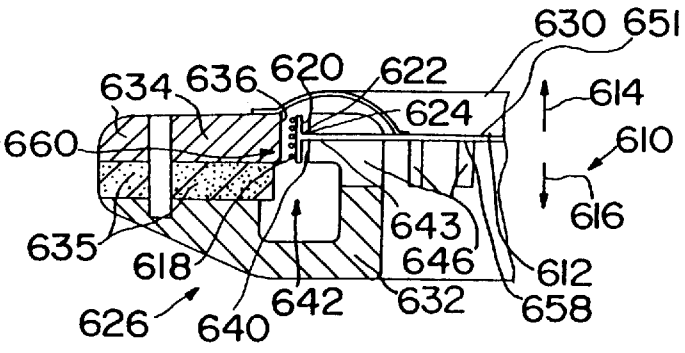
FIG. 8 illustrates a fragmentary transverse sectional view through a loudspeaker constructed according to the invention.

Referring now to FIG. 8, a loudspeaker 610 includes a diaphragm 612 which moves back and forth in the directions indicated by arrows 614, 616 in response to current flow through a voice coil 618 formed on a right cylindrical coil form 620 mounted at several locations 622 to the outer perimeter 624 of diaphragm 612. Diaphragm 612 is supported from a combination frame and loudspeaker voice coil motor stator 626 by an outer surround or compliance 630. The combination frame and motor stator 626 includes an inner return 632 which supports lines of magnetic flux, an outer return 634 which supports lines of magnetic flux, and a permanent magnet 635 which provides the magnetic flux to returns 632, 634. An outer pole 636 is formed on a forwardmost (uppermost in FIG. 8) facing surface of return 634. Again, loudspeaker 610 can be mounted in any orientation.

Inner poles 640 are formed on axially forwardmost (in FIG. 8 uppermost), outwardly facing surfaces of return 632. Coil form 620 and the voice coil 618 supported on coil form 620 reciprocate in the magnetic field in the air gap 642 between poles 636, 640 in response to alternating current flow in voice coil 618. Diaphragm 612 is secured at perimetrally spaced locations 622 to coil form 620 and moves with coil form 620. The frequency of the alternating current in coil 618 determines the frequency of the audio reproduced by diaphragm 612. Slots 646 are formed between adjacent inner poles 640. Ribs extend outward from the perimeter of diaphragm 612 through slots 646 to coil form 620.

Compliance 630 is coupled at its perimetrally inner extent to the upwardly facing surface 651 of diaphragm 612. Compliance 630 is coupled at its perimetrally outer extent to the uppermost or forwardmost region of outer return 634. Cancellation or edge effects between the forward radiated signal from surface 651 of diaphragm 612 and the backward radiated signal from surface 658 thereof are minimized.

Again, diaphragm 612 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnet 635 can be any suitable type, such as, for example, ceramic, rare earth, AlNiCo, and so on. Flux returns 632, 634 could be any suitable material. Of course, one or both of the inner and outer returns 632, 634 could be constructed in whole or in part from perment magnetic material, in which case a separate permanent magnet 635 would not be necessary. The remainder of the frame illustratively could be formed in whole or in part from metal, such as steel or aluminum, or from any suitable filled or unfilled resin, or from any other suitable material.

Figure 9:
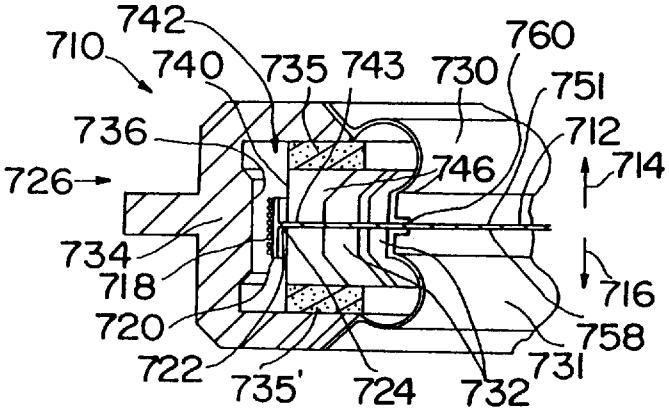
FIG. 9 illustrates a fragmentary transverse sectional view through a loudspeaker constructed according to the invention; and, FIG. 10 illustrates a fragmentary transverse sectional view through a loudspeaker constructed according to the invention.

Referring now to FIG. 9, a loudspeaker 710 includes a diaphragm 712 which moves back and forth in the directions indicated by arrows 714, 716 in response to current flow through a voice coil 718 formed on a right cylindrical coil form 720 mounted at several locations 722 to the outer perimeter 724 of diaphragm 712. Diaphragm 712 is supported from a combination frame and loudspeaker voice coil motor stator 726 by perimetral surrounds or compliances 730 and 731. The combination frame and motor stator 726 includes inner returns 732 which support lines of magnetic flux, an outer return 734 which supports lines of magnetic flux, and permanent magnets 735, 735' which provide the magnetic flux to returns 732, 734. An outer pole 736 is formed on an inwardly facing surface of return 734. Again, loudspeaker 710 can be mounted in any orientation.

Inner poles 740 are formed on outwardly facing surfaces of returns 732. Coil form 720 and the voice coil 718 supported on coil form 720 reciprocate in the magnetic field in the air gap 742 between poles 736, 740 in response to alternating current flow in voice coil 718. Diaphragm 712 which is secured at perimetrally spaced locations 722 to coil form 720 and moves with coil form 720. The frequency of the alternating current in coil 718 determines the frequency of the audio reproduced by diaphragm 712. Slots 746 are formed between adjacent inner poles 740. Ribs extend outward from the perimeter of diaphragm 712 through slots 746 to coil form 720.

Compliances 730 and 731 are coupled at their perimetrally inner extents to the upwardly facing 751 and downwardly facing 758 surfaces, respectively, of diaphragm 712. Compliances 730 and 731 are coupled at their perimetrally outer extents to the uppermost or forwardmost region of outer return 734 and the lowermost or rearwardmost region of outer return 734. Cancellation or edge effects between the forward radiated signal from surface 751 of diaphragm 712 and the backward radiated signal from surface 758 thereof are minimized.

Again, diaphragm 712 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnets 735, 735' can be any suitable type, such as, for example, ceramic, rare earth, AlNiCo, and so on. Flux returns 732, 734 could be any suitable material. Of course, one or both of the inner and outer returns 732, 734 could be constructed in whole or in part from perment magnetic material, in which case a separate permanent magnets 735, 735' would not be necessary. The remainder of the frame illustratively could be formed in whole or in part from metal, such as steel or aluminum, or from any suitable filled or unfilled resin, or from any other suitable material.

Figure 10:
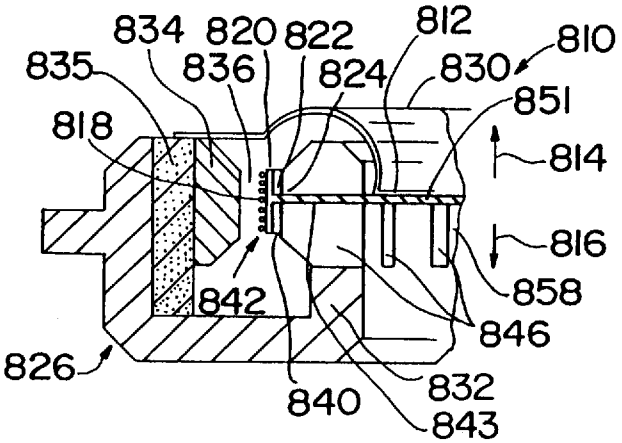

Referring now to FIG. 10, a loudspeaker 810 includes a diaphragm 812 which moves back and forth in the directions indicated by arrows 814, 816 in response to current flow through a voice coil 818 formed on a right cylindrical coil form 820 mounted at several locations 822 to the outer perimeter 824 of diaphragm 812. Diaphragm 812 is supported from a combination frame and loudspeaker voice coil motor stator 826 by compliance 830. The combination frame and motor stator 826 includes an inner return 832 which supports lines of magnetic flux, an outer return 834 which supports lines of magnetic flux, and a permanent magnet 835 which provides the magnetic flux to returns 832, 834. An outer pole 836 is formed on an inwardly facing surface of return 834. Again, loudspeaker 810 can be mounted in any orientation.

Inner poles 840 are formed on axially forwardmost (in FIG. 10 uppermost), outwardly facing surfaces of return 832. Coil form 820 and the voice coil 818 supported on coil form 820 reciprocate in the extending magnetic field in the air gap 842 between poles 836, 840 in response to alternating current flow in voice coil 818. Diaphragm 812 is secured at perimetrally spaced locations 822 to coil form 820 and moves with coil form 820. The frequency of the alternating current in coil 818 determines the frequency of the audio reproduced by diaphragm 812. Slots 846 are formed between adjacent inner poles 840. Ribs extend outward from the perimeter of diaphragm 812 through slots 846 to coil form 820.

Compliance 830 is coupled at its perimetrally inner extent to the upwardly facing surface 851 of diaphragm 812. Compliance 830 is coupled at its perimetrally outer extent to the uppermost or forwardmost region of outer return 834. Cancellation or edge effects between the forward radiated signal from surface 851 of diaphragm 812 and the backward radiated signal from surface 858 thereof are minimized.

Again, diaphragm 812 can be constructed in whole or in part from any suitable material such as stiff, treated paper, filled or unfilled resin formed, for example, into relatively stiff closed- or open-cell foam sheets, metal foil formed, for example, into honeycomb cellular configuration, or the like. Magnet 835 can be any suitable type, such as, for example, ceramic, rare earth, AlNiCo, and so on. Flux returns 832, 834 could be any suitable material. Of course, one or both of the inner and outer returns 832, 834 could be constructed in whole or in part from permanent magnetic material, in which case a separate permanent magnet 835 would not be necessary. The remainder of the frame illustratively could be formed in whole or in part from metal, such as steel or aluminum, or from any suitable filled or unfilled resin, or from any other suitable material.

What is claimed is:

1. A loudspeaker comprising a diaphragm having an outer perimeter, a voice coil, means for mounting the voice coil to the outer perimeter, a frame for supporting the diaphragm, and a motor stator providing a magnetic field in which the voice coil is supported, current through the voice coil reciprocating the voice coil and the diaphragm coupled thereto, the means for mounting the voice coil to the outer perimeter comprising ribs extending outwardly at the outer perimeter of the diaphragm, the motor stator including at least one inner flux return providing slots through which the ribs extend between the outer perimeter of the diaphragm and the voice coil.

2. The loudspeaker of claim 1 wherein the motor stator further comprises at least one permanent magnet oriented adjacent the at least one inner flux return.

3. The loudspeaker of claim 1 wherein the at least one inner flux return comprises multiple inner flux returns, the slots being defined between adjacent ones of the inner flux returns.

4. The loudspeaker of claim 3 wherein the motor stator further comprises at least one permanent magnet oriented adjacent at least one of the multiple inner flux returns.

5. The loudspeaker of claim 4 wherein the motor stator comprises at least one permanent magnet oriented adjacent all of the multiple inner flux returns.

6. The loudspeaker of claim 5 wherein the motor stator comprises at least two permanent magnets oriented adjacent all of the multiple inner flux returns.

7. The loudspeaker of claim 2, 4, 5 or 6 wherein the motor stator further comprises at least one outer flux return, the permanent magnet oriented between the at least one inner flux return and the at least one outer flux return.

8. The loudspeaker of claim 1 or 4 wherein the motor stator further comprises at least one outer flux return, the at least one inner flux return and the at least one outer flux return defining between them an air gap, the magnetic field being established in the air gap, and the means for supporting the voice coil in the magnetic field comprising means for supporting the voice coil in the air gap.

9. The loudspeaker of claim 8 wherein the motor stator further comprises a permanent magnet oriented adjacent the at least one inner flux return and the at least one outer flux return.

10. A loudspeaker comprising a diaphragm having an outer perimeter and a central axis defining between them a relatively inner region of the diaphragm extending outwardly from the axis and a relatively outer region of the diaphragm extending inwardly from the outer perimeter, a voice coil, a frame for supporting the diaphragm, and a motor stator providing a magnetic field in which the voice coil is supported, current through the voice coil reciprocating the voice coil and the diaphragm coupled thereto, the means for mounting the voice coil comprising first ribs extending outwardly from the inner region, the first ribs coupled to the voice coil between the inner and outer regions, the motor stator including at least one inner flux return providing first slots through which the first ribs extend between the inner region and the voice coil.

11. The loudspeaker of claim 10 wherein the at least one inner flux return comprises multiple inner flux returns, the first slots being defined between adjacent ones of the inner flux returns.

12. The loudspeaker of claim 11 wherein the motor stator further comprises at least one permanent magnet oriented adjacent the multiple inner flux returns.

13. The loudspeaker of claim 12 wherein the motor stator comprises multiple permanent magnets oriented adjacent the multiple inner flux returns.

14. The loudspeaker of claim 10 wherein the motor stator further comprises at least one permanent magnet oriented adjacent the at least one inner flux return.

15. The loudspeaker of claim 10 further comprising second ribs extending inwardly from the outer region, the second ribs coupled to the voice coil between the inner and outer regions, the motor stator including at least one outer flux return providing second slots through which the second ribs extend between the outer region and the voice coil.

16. The loudspeaker of claim 15 wherein the at least one inner flux return and the at least one outer flux return define between them an air gap, the magnetic field being established in the air gap.

17. The loudspeaker of claim 16 wherein the at least one outer flux return comprises multiple outer flux returns, the second slots being defined between adjacent ones of the outer flux returns.

18. The loudspeaker of claim 17 wherein the motor stator further comprises at least one permanent magnet oriented adjacent the multiple outer flux returns.

19. The loudspeaker of claim 18 wherein the motor stator further comprises multiple permanent magnets oriented adjacent the multiple outer flux returns.

20. The loudspeaker of claim 15 or 16 wherein the motor stator further comprises at least one permanent magnet oriented adjacent the at least one inner flux return and the at least one outer flux return.

21. The loudspeaker of claim 15 wherein the at least one outer flux return comprises multiple outer flux returns, the second slots being defined between adjacent ones of the outer flux returns.

22. A loudspeaker comprising a diaphragm having an outer perimeter and a central axis defining between them a relatively inner region of the diaphragm extending outwardly from the axis and a relatively outer region of the diaphragm extending inwardly from the outer perimeter, a voice coil, a frame for supporting the diaphragm, and a motor stator providing a magnetic field in which the voice coil is supported, current through the voice coil reciprocating the voice coil and the diaphragm coupled thereto, the means for mounting the voice coil comprising first ribs extending inwardly from the outer region, the first ribs supporting the voice coil between the inner and outer regions, the motor stator including at least one outer flux return providing first slots through which the first ribs extend between the outer region and the voice coil.

23. The loudspeaker of claim 22 wherein the at least one outer flux return comprises multiple outer flux returns, the first slots being defined between adjacent ones of the outer flux returns.

24. The loudspeaker of claim 23 wherein the motor stator further comprises multiple permanent magnets oriented adjacent the multiple outer flux returns.

25. The loudspeaker of claim 22 wherein the motor stator further comprises at least one permanent magnet oriented adjacent the at least one outer flux return.

* * * * *